US011637399B2

(12) United States Patent
Lin et al.

(10) Patent No.: US 11,637,399 B2
(45) Date of Patent: Apr. 25, 2023

(54) CONNECTOR COMBINATION STRUCTURE AND CONNECTOR THEREOF

(71) Applicant: Wistron NeWeb Corp., Hsinchu (TW)

(72) Inventors: Che-Min Lin, Hsinchu (TW); Po-Nien Ko, Hsinchu (TW); Yi-Chieh Wang, Hsinchu (TW); Po-Wen Wang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 80 days.

(21) Appl. No.: 17/393,569

(22) Filed: Aug. 4, 2021

(65) Prior Publication Data

US 2022/0216648 A1 Jul. 7, 2022

(30) Foreign Application Priority Data

Jan. 6, 2021 (TW) ..... 110100387

(51) Int. Cl.
*H01R 13/627* (2006.01)
*H01R 13/422* (2006.01)
*H01R 13/639* (2006.01)

(52) U.S. Cl.
CPC ..... *H01R 13/6277* (2013.01); *H01R 13/4226* (2013.01); *H01R 13/6275* (2013.01); *H01R 13/639* (2013.01); *H01R 13/6273* (2013.01)

(58) Field of Classification Search
CPC ..... H01R 13/6277; H01R 13/6275; H01R 13/6273; H01R 13/639; H01R 13/4226
See application file for complete search history.

(56) References Cited

U.S. PATENT DOCUMENTS 6,343,948 B1 * 2/2002 Nutzel ..... H01R 13/6273 439/358
10,254,308 B2 * 4/2019 Chen ..... H01R 13/62955
10,673,179 B1 * 6/2020 Harris ..... H01R 13/6691

FOREIGN PATENT DOCUMENTS

CN 211907772 U 11/2020

* cited by examiner

*Primary Examiner* — Briggitte R. Hammond
(74) *Attorney, Agent, or Firm* — McClure, Qualey & Rodack, LLP

(57) ABSTRACT

A connector combination structure is provided. The connector combination structure includes a first connector and a second connector. The first connector includes a first joint and at least one wedging portion. The second connector includes a housing, a second joint and at least one wedging arm. The second joint and the wedging arm are disposed in the housing. The wedging arm is adapted to be rotated between a first arm position and a second arm position. The first joint is adapted to be inserted into the housing to be connected to the second joint. When the wedging arm is located in the first arm position, the wedging arm is adapted to wedge the wedging portion. When the wedging arm is in the second arm position, the wedging arm is adapted to release the wedging portion.

16 Claims, 6 Drawing Sheets

CONNECTOR COMBINATION STRUCTURE AND CONNECTOR THEREOF

CROSS REFERENCE TO RELATED APPLICATIONS

This Application claims priority of Taiwan Patent Application No. 110100387, filed on Jan. 6, 2021, the entirety of which is incorporated by reference herein.

BACKGROUND OF THE INVENTION

Field of the Invention

The present invention relates to a connector combination structure, and in particular to a connector combination structure with a wedging arm.

Description of the Related Art

A conventional electronic device, such as dash cam, whose power is supplied by an adapter. The cable of the dash cam has a first connector. The cable of the adapter has a second connector. The first connector is adapted to be connected to the second connector. However, the vehicle's vibration or unexpected cable pulling by the user may separate the first connector from the second connector. Therefore, an additional mechanism is required to prevent the first connector from being unexpectedly separated from the second connector.

BRIEF SUMMARY OF THE INVENTION

Embodiments of the invention are provided to address the aforementioned difficulty.

In one embodiment, a connector combination structure is provided. The connector combination structure includes a first connector and a second connector. The first connector includes a first joint and at least one wedging portion. The second connector includes a housing, a second joint and at least one wedging arm. The second joint and the wedging arm are disposed in the housing. The wedging arm is adapted to be rotated between a first arm position and a second arm position. The first joint is adapted to be inserted into the housing to be connected to the second joint. When the wedging arm is located in the first arm position, the wedging arm is adapted to wedge the wedging portion. When the wedging arm is in the second arm position, the wedging arm is adapted to release the wedging portion.

In one embodiment, the second connector further comprises an operation portion and an elastic unit, the operation portion connects the wedging arm, the elastic unit is connected to the wedging arm, the operation portion is adapted to be operated by a user to push the wedging arm from the first arm position to the second arm position, the elastic unit exerts an elastic force on the wedging arm, and the wedging arm tends to move from the second arm position to the first arm position due to the elastic force.

In one embodiment, the second connector further comprises a base and an operation portion, the wedging arm comprises a hook, one end of the wedging arm is connected to the base, the hook is formed on the other end of the wedging arm, the operation portion is connected to the wedging arm, the operation portion is adapted to be operated by a user to push the wedging arm from the first arm position to the second arm position, the wedging arm per se provides an elastic force, and the wedging arm tends to move from the second arm position to the first arm position due to the elastic force.

In the connector combination structure of the embodiment of the invention, the wedging arm is adapted to wedge the wedging portion, and the connection between the first connector and the second connector is increased, and the first connector is prevented from being separated from the second connector. Additionally, in the first embodiment of the invention, the operation portion, the elastic unit and the wedging arm are integrally formed. The second connector of the first embodiment of the invention therefore has simple structure, lower cost, and can be easily assembled. Similarly, in the second embodiment of the invention, the wedging arm, the base and the operation portion are integrally formed. The second connector of the second embodiment of the invention also has simple structure, lower cost, and can be easily assembled. When user desires to separate the first connector from the second connector, the user only needs to press the operation portion, and the first connector can be easily separated from the second connector.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
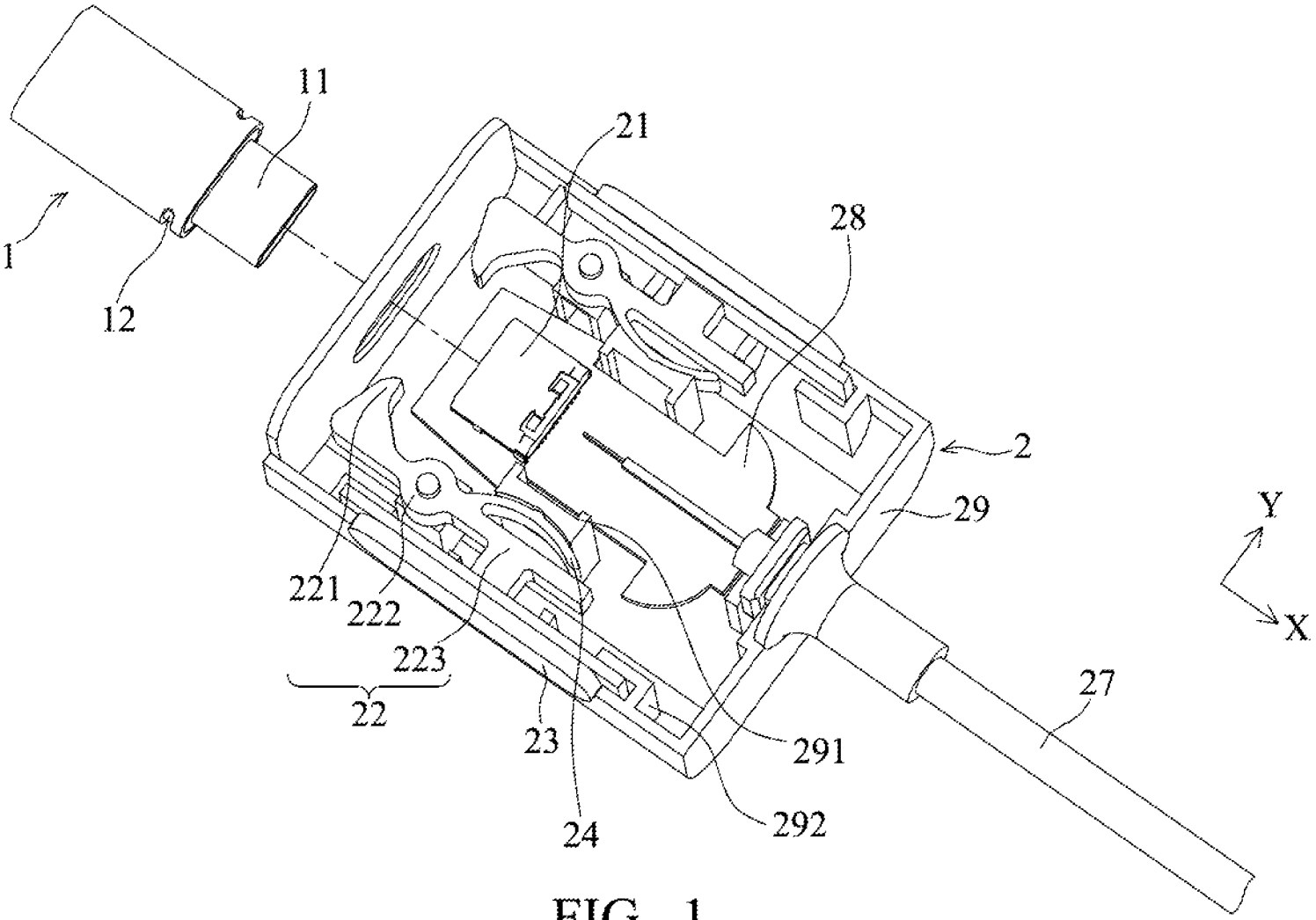
FIG. 1 shows a connector combination structure of a first embodiment of the invention, wherein a first connector is not connected to a second connector.
Figure 2A:
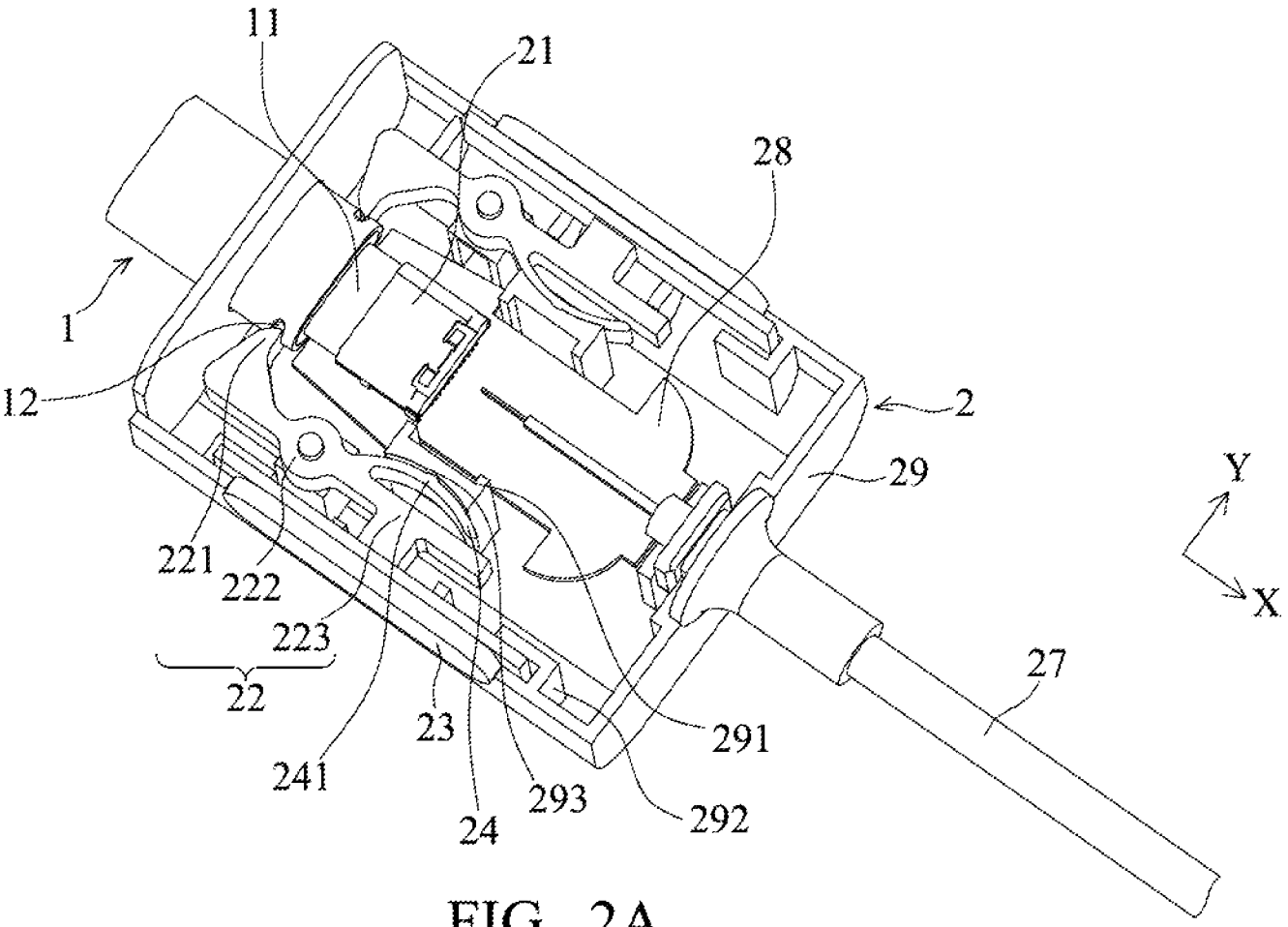
FIG. 2A is an assembled view of the connector combination structure of the first embodiment of the invention, wherein a wedging arm is in a first arm position.
Figure 2B:
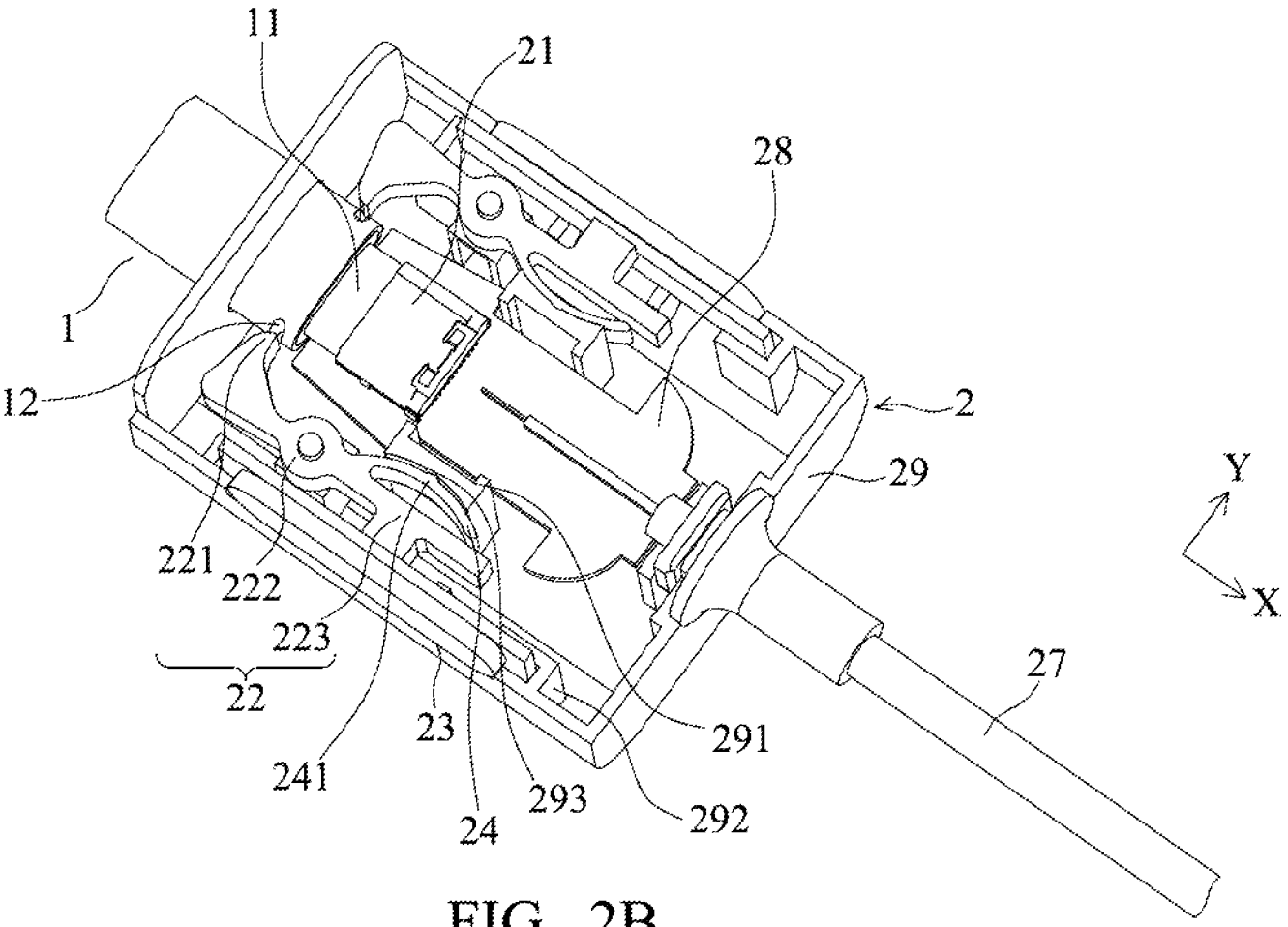
FIG. 2B is an assembled view of the connector combination structure of the first embodiment of the invention, wherein the wedging arm is in a second arm position.

FIG. 1 shows a connector combination structure of a first embodiment of the invention, wherein a first connector is not connected to a second connector. FIG. 2A is an assembled view of the connector combination structure of the first embodiment of the invention, wherein a wedging arm is in a first arm position. FIG. 2B is an assembled view of the connector combination structure of the first embodiment of the invention, wherein the wedging arm is in a second arm position. With reference to FIGS. 1, 2A and 2B, the connector combination structure of the first embodiment of the invention includes a first connector 1 and a second connector 2. The first connector 1 includes a first joint 11 and at least one wedging portion 12. The second connector 2 includes a housing 29, a second joint 21 and at least one wedging arm 22. The second joint 21 and the wedging arm 22 are disposed in the housing 29. The wedging arm 22 is adapted to be rotated between a first arm position (FIG. 2A) and a second arm position (FIG. 2B). The first joint 11 is adapted to be inserted into the housing 29 to be connected to the second joint 21. When the wedging arm 22 is located in the first arm position (FIG. 2A), the wedging arm 22 is adapted to wedge the wedging portion 12. When the wedging arm 22 is in the second arm position (FIG. 2B), the wedging arm 22 is adapted to release the wedging portion 12.

With reference to FIGS. 1, 2A and 2B, in one embodiment, the second connector 2 further comprises an operation portion 23 and an elastic unit 24. The operation portion 23 connects the wedging arm 22. The elastic unit 24 is connected to the wedging arm 22. The operation portion 23 is adapted to be operated by a user to push the wedging arm 22 from the first arm position to the second arm position. The elastic unit 24 exerts an elastic force on the wedging arm, and the wedging arm 22 tends to move from the second arm position to the first arm position due to the elastic force.

With reference to FIGS. 1, 2A and 2B, in one embodiment, the wedging arm 22 comprises a hook 221, an arm pivoting portion 222 and a rod section 223. The wedging arm 22 pivots on the housing 29 via the arm pivoting portion 222. The hook 221 is adapted to wedge the wedging portion 12. The arm pivoting portion 222 is located between the hook 221 and the rod section 223. The operation portion 23 and the elastic unit 24 are connected to the rod section 223.

With reference to FIGS. 1, 2A and 2B, in one embodiment, the first joint 11 is adapted to be inserted into the housing 29 in a first direction X to connect the second joint 21. The operation portion 23 is adapted to be pressed in a second direction Y to move the wedging arm 22 from the first arm position to the second arm position. The first direction X is perpendicular to the second direction Y.

With reference to FIGS. 1, 2A and 2B, in one embodiment, the housing 29 further comprises an inner wall 291. The elastic unit 24 is disposed between the rod section 223 and the inner wall 291. When the operation portion 23 is pressed in the second direction Y, the elastic unit 24 is pressed toward the inner wall 291 to generate the elastic force.

With reference to FIGS. 1, 2A and 2B, in one embodiment, the elastic unit 24 is a curved elastic-sheet. At least one end of the curved elastic-sheet is connected to the rod section 223. In one embodiment, the elastic unit 24 further comprises a positioning protrusion 241. The inner wall 291 further comprises a wall recess 293. The positioning protrusion 241 is wedged to the wall recess 293 to restrict the position of the elastic unit 24.

With reference to FIGS. 1, 2A and 2B, in one embodiment, the operation portion 23, the elastic unit 24 and the wedging arm 22 are integrally formed.

With reference to FIGS. 1, 2A and 2B, in one embodiment, the housing 29 further comprises a housing restriction slot 292. At least a part of the operation portion 23 is moved in the housing restriction slot 292, and the operation portion 23 is therefore moved in the second direction Y.

With reference to FIGS. 1, 2A and 2B, in one embodiment, the second connector 2 further comprises a circuit board 28 and a cable 27. The circuit board 28 is disposed in the housing 29. The cable 27 is coupled to the circuit board 28. The second joint 21 is disposed on the circuit board 28.

Figure 3:
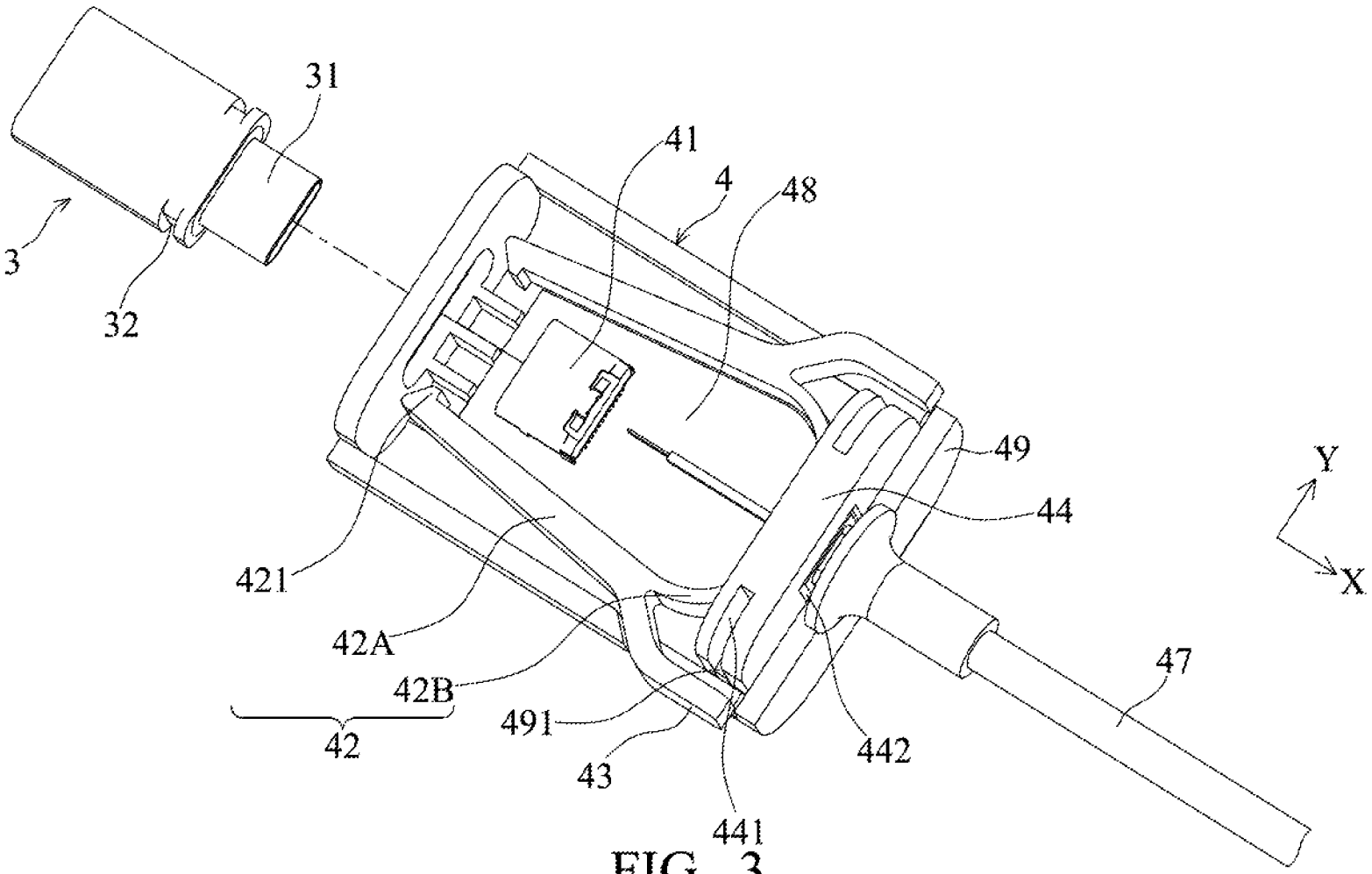
FIG. 3 shows a connector combination structure of a second embodiment of the invention, wherein a first connector is not connected to a second connector.
Figure 4A:
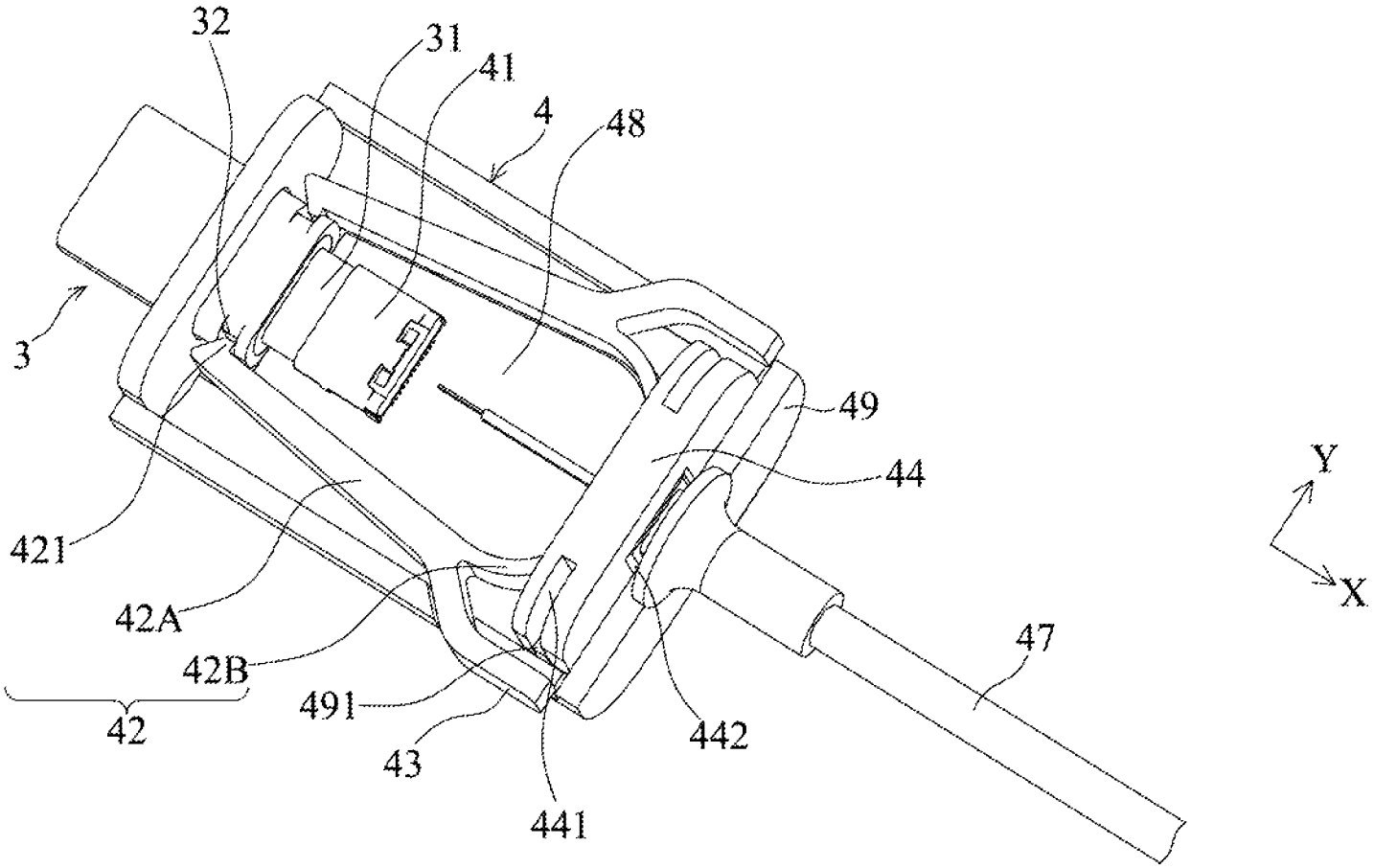
FIG. 4A is an assembled view of the connector combination structure of the second embodiment of the invention, wherein a wedging arm is in a first arm position.
Figure 4B:
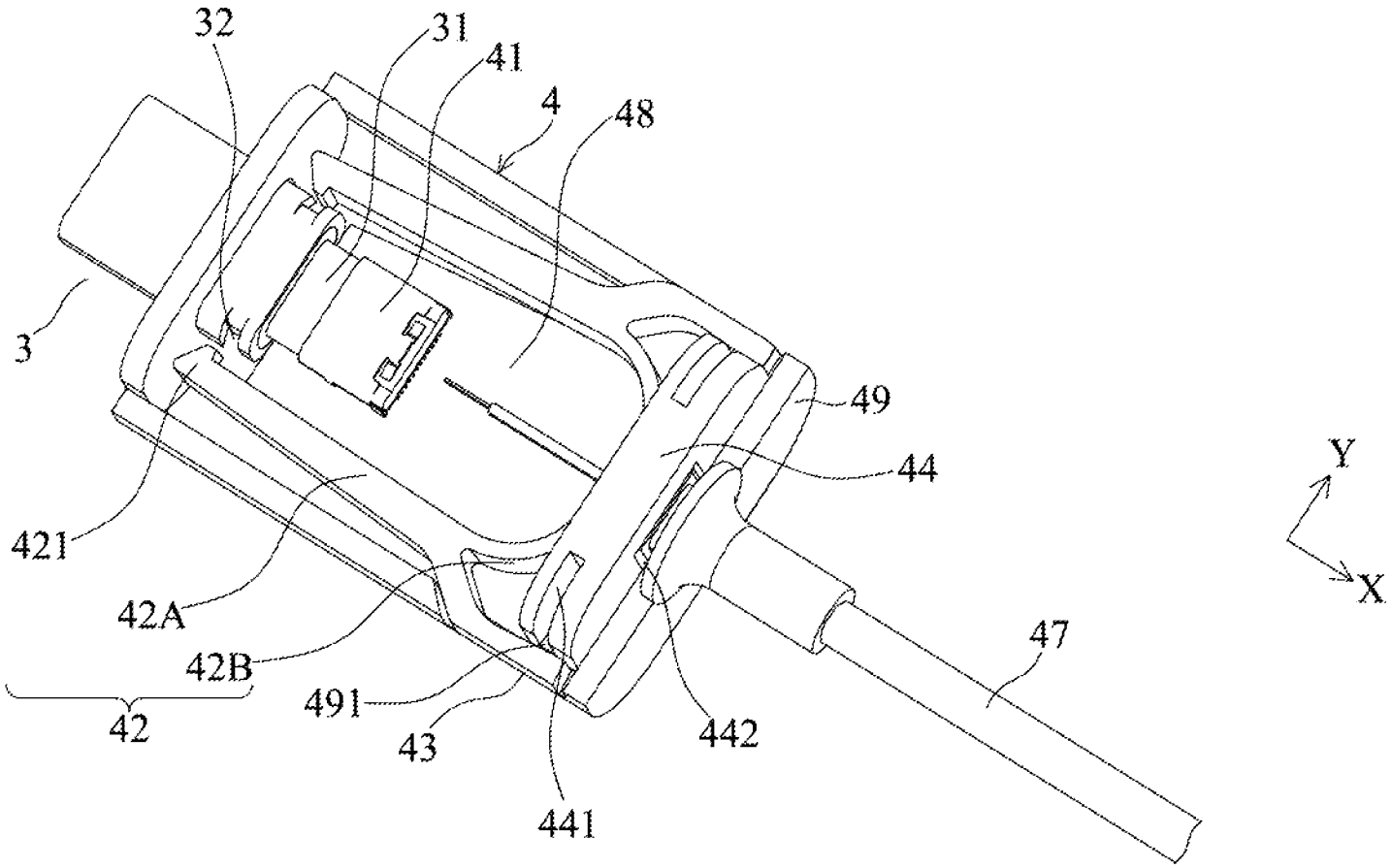
FIG. 4B is an assembled view of the connector combination structure of the second embodiment of the invention, wherein the wedging arm is in a second arm position.

FIG. 3 shows a connector combination structure of a second embodiment of the invention, wherein a first connector is not connected to a second connector. FIG. 4A is an assembled view of the connector combination structure of the second embodiment of the invention, wherein a wedging arm is in a first arm position. FIG. 4B is an assembled view of the connector combination structure of the second embodiment of the invention, wherein the wedging arm is in a second arm position. With reference to FIGS. 3, 4A and 4B, the connector combination structure of the second embodiment of the invention includes a first connector 3 and a second connector 4. The first connector 3 includes a first joint 31 and at least one wedging portion 32. The second connector 4 includes a housing 49, a second joint 41 and at least one wedging arm 42. The second joint 41 and the wedging arm 42 are disposed in the housing 49. The wedging arm 42 is adapted to be rotated between a first arm position (FIG. 4A) and a second arm position (FIG. 4B). The first joint 31 is adapted to be inserted into the housing 49 to be connected to the second joint 41. When the wedging arm 42 is located in the first arm position (FIG. 4A), the wedging arm 42 is adapted to wedge the wedging portion 32. When the wedging arm 42 is in the second arm position (FIG. 4B), the wedging arm 42 is adapted to release the wedging portion 32.

With reference to FIGS. 3, 4A and 4B, in one embodiment, the second connector 4 further comprises a base 44 and an operation portion 43. The wedging arm 42 comprises a hook 421. One end of the wedging arm 42 is connected to the base 44. The hook 421 is formed on the other end of the wedging arm 42. The operation portion 43 is connected to the wedging arm 42. The operation portion 43 is adapted to be operated by a user to push the wedging arm 42 from the first arm position (FIG. 4A) to the second arm position (FIG. 4B). The wedging arm 42 per se provides an elastic force. The wedging arm 42 tends to move from the second arm position (FIG. 4B) to the first arm position (FIG. 4A) due to the elastic force.

With reference to FIGS. 3, 4A and 4B, in one embodiment, the first joint 31 is adapted to be inserted into the housing 49 in a first direction X to connect the second joint 41. The operation portion 43 is adapted to be pressed in a second direction Y to move the wedging arm 42 from the first arm position to the second arm position. The first direction X is perpendicular to the second direction Y.

With reference to FIGS. 3, 4A and 4B, in one embodiment, the wedging arm 42, the base 44 and the operation portion 43 are integrally formed.

With reference to FIGS. 3, 4A and 4B, in one embodiment, the wedging arm 42 comprises a first section 42A and a second section 42B. The first section 42A connects the operation portion 43 to the hook 421. The second section 42B connects the operation portion 43 to the base 44. The first section 42A is longer than the second section 42B. In one embodiment, the first section 42A is thicker than the second section 42B. The second section 42B is curved.

With reference to FIGS. 3, 4A and 4B, in one embodiment, the housing 49 comprises a housing restriction rib 491. The base 44 comprises a base restriction slot 441. The base restriction slot 441 is wedged to the housing restriction rib 491.

With reference to FIGS. 3, 4A and 4B, in one embodiment, the second connector 4 further comprises a circuit board 48 and a cable 47. The circuit board 48 is disposed in the housing 49. The cable 47 is coupled to the circuit board 48. The second joint 41 is disposed on the circuit board 48. The base 44 comprises a base opening 442, and the cable 47 passes through the base opening 442.

In the connector combination structure of the embodiment of the invention, the wedging arm is adapted to wedge the wedging portion, and the connection between the first connector and the second connector is increased, and the first connector is prevented from being separated from the second connector. Additionally, in the first embodiment of the invention, the operation portion, the elastic unit and the wedging arm are integrally formed. The second connector of the first embodiment of the invention therefore has simple structure, lower cost, and can be easily assembled. Similarly, in the second embodiment of the invention, the wedging arm, the base and the operation portion are integrally formed. The second connector of the second embodiment of the invention also has simple structure, lower cost, and can be easily assembled. When user desires to separate the first connector from the second connector, the user only needs to press the operation portion, and the first connector can be easily separated from the second connector.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A connector combination structure, comprising:

a first connector, comprising a first joint and at least one wedging portion;

a second connector, comprising a housing, a second joint and at least one wedging arm, wherein the second joint and the wedging arm are disposed in the housing, the wedging arm is adapted to be rotated between a first arm position and a second arm position, the first joint is adapted to be inserted into the housing to be connected to the second joint, and when the wedging arm is located in the first arm position, the wedging arm is adapted to wedge the wedging portion, and when the wedging arm is in the second arm position, the wedging arm is adapted to release the wedging portion, wherein the second connector further comprises an operation portion and an elastic unit, the operation portion connects the wedging arm, the elastic unit is connected to the wedging arm, the operation portion is adapted to be operated by a user to push the wedging arm from the first arm position to the second arm position, the elastic unit exerts an elastic force on the wedging arm, and the wedging arm tends to move from the second arm position to the first arm position due to the elastic force, wherein the wedging arm comprises a hook, an arm pivoting portion and a rod section, the wedging arm pivots on the housing via the arm pivoting portion, the hook is adapted to wedge the wedging portion, the arm pivoting portion is located between the hook and the rod section, and the operation portion and the elastic unit are connected to the rod section.

2. The connector combination structure as claimed in claim 1, wherein the first joint is adapted to be inserted into the housing in a first direction to connect the second joint, the operation portion is adapted to be pressed in a second direction to move the wedging arm from the first arm position to the second arm position, and the first direction is perpendicular to the second direction.

3. The connector combination structure as claimed in claim 2, wherein the housing further comprises an inner wall, the elastic unit is disposed between the rod section and the inner wall, and when the operation portion is pressed in the second direction, the elastic unit is pressed toward the inner wall to generate the elastic force.

4. The connector combination structure as claimed in claim 3, wherein the elastic unit comprises a curved elastic-sheet, and at least one end of the curved elastic-sheet is connected to the rod section.

5. The connector combination structure as claimed in claim 4, wherein the operation portion, the elastic unit and the wedging arm are integrally formed.

6. The connector combination structure as claimed in claim 5, wherein the housing further comprises a housing restriction slot, and at least a part of the operation portion is moved in the housing restriction slot.

7. The connector combination structure as claimed in claim 1, wherein the second connector further comprises a base and an operation portion, the wedging arm comprises a hook, one end of the wedging arm is connected to the base, the hook is formed on the other end of the wedging arm, the operation portion is connected to the wedging arm, the operation portion is adapted to be operated by a user to push the wedging arm from the first arm position to the second arm position, the wedging arm provides an elastic force, and the wedging arm tends to move from the second arm position to the first arm position due to the elastic force.

8. The connector combination structure as claimed in claim 7, wherein the first joint is adapted to be inserted into the housing in a first direction to connect the second joint, the operation portion is adapted to be pressed in a second direction to move the wedging arm from the first arm position to the second arm position, and the first direction is perpendicular to the second direction.

9. The connector combination structure as claimed in claim 8, wherein the wedging arm, the base and the operation portion are integrally formed.

10. The connector combination structure as claimed in claim 8, wherein the wedging arm comprises a first section and a second section, the first section connects the operation portion to the hook, the second section connects the operation portion to the base, and a length of the first section is longer than a length of the second section.

11. The connector combination structure as claimed in claim 10, wherein a thickness of the first section is greater than a thickness of the second section.

12. The connector combination structure as claimed in claim 11, wherein the second section is curved.

13. The connector combination structure as claimed in claim 10, wherein the housing comprises a housing restriction rib, the base comprises a base restriction slot, and the base restriction slot is wedged to the housing restriction rib.

14. A connector combination structure, comprising:

a first connector, comprising a first joint and at least one wedging portion;

a second connector, comprising a housing, a second joint and at least one wedging arm, wherein the second joint and the wedging arm are disposed in the housing, the wedging arm is adapted to be rotated between a first arm position and a second arm position, the first joint is adapted to be inserted into the housing to be connected to the second joint, and when the wedging arm is located in the first arm position, the wedging arm is adapted to wedge the wedging portion, and when the wedging arm is in the second arm position, the wedging arm is adapted to release the wedging portion, wherein the second connector further comprises a base and an operation portion, the wedging arm comprises a hook, one end of the wedging arm is connected to the base, the hook is formed on the other end of the wedging arm, the operation portion is connected to the wedging arm, the operation portion is adapted to be operated by a user to push the wedging arm from the first arm position to the second arm position, the wedging arm provides an elastic force, and the wedging arm tends to move from the second arm position to the first arm position due to the elastic force, wherein the first joint is adapted to be inserted into the housing in a first direction to connect the second joint, the operation portion is adapted to be pressed in a second direction to move the wedging arm from the first arm position to the second arm position, and the first direction is perpendicular to the second direction, wherein the wedging arm comprises a first section and a second section, the first section connects the operation portion to the hook, the second section connects the operation portion to the base, and a length of the first section is longer than a length of the second section, wherein the second connector further comprises a circuit board and a cable, the circuit board is disposed in the housing, the cable is coupled to the circuit board, the base comprises a base opening, and the cable passes through the base opening.

15. A connector, comprising:

a housing;

a joint; and at least one wedging arm, wherein the joint and the wedging arm are disposed in the housing, and the wedging arm is adapted to be rotated between a first arm position and a second arm position, wherein the connector further comprises an operation portion and an elastic unit, the operation portion connects the wedging arm, the elastic unit is connected to the wedging arm, the operation portion is adapted to be operated by a user to push the wedging arm from the first arm position to the second arm position, the elastic unit exerts an elastic force on the wedging arm, and the wedging arm tends to move from the second arm position to the first arm position due to the elastic force, wherein the wedging arm comprises a hook, an arm pivoting portion and a rod section, the wedging arm pivots on the housing via the arm pivoting portion, the arm pivoting portion is located between the hook and the rod section, and the operation portion and the elastic unit are connected to the rod section.

16. A connector, comprising:

a housing;

a joint; and at least one wedging arm, wherein the joint and the wedging arm are disposed in the housing, and the wedging arm is adapted to be rotated between a first arm position and a second arm position, wherein the connector further comprises a base and an operation portion, the wedging arm comprises a hook, one end of the wedging arm is connected to the base, the hook is formed on the other end of the wedging arm, the operation portion is connected to the wedging arm, the operation portion is adapted to be operated by a user to push the wedging arm from the first arm position to the second arm position, the wedging arm provides an elastic force, and the wedging arm tends to move from the second arm position to the first arm position due to the elastic force, wherein the connector further comprises a circuit board and a cable, the circuit board is disposed in the housing, the cable is coupled to the circuit board, the base comprises a base opening, and the cable passes through the base opening.

* * * * *